United States Patent [19]

Yoshida

[11] 4,350,858

[45] Sep. 21, 1982

[54] APPARATUS AND METHOD FOR CONTROLLING ELECTRONIC CONTROLLED COOKING APPARATUS

[75] Inventor: Masahiko Yoshida, Otsu, Japan

[73] Assignee: Sanyo Electric Co., Ltd., Moriguchi, Japan

[21] Appl. No.: 120,740

[22] Filed: Feb. 12, 1980

[30] Foreign Application Priority Data

Feb. 19, 1979 [JP] Japan ..... 54-18614

[51] Int. Cl.[3] ..... H05B 6/68

[52] U.S. Cl. ..... 219/10.55 B; 219/506; 219/10.55 E; 99/328; 340/593

[58] Field of Search ..... 219/10.55 B, 10.55 M, 219/10.55 E, 10.55 R, 506; 99/421 TP, 328; 340/584, 588, 589, 593

[56] References Cited

U.S. PATENT DOCUMENTS 4,093,841 6/1978 Dills ..... 219/10.55 R 4,158,759 6/1979 Mason ..... 219/10.55 B

FOREIGN PATENT DOCUMENTS 1060116 8/1979 Canada ..... 219/10.55 B

OTHER PUBLICATIONS

"TMS 1117 MW Oven Controller Manual", Texas Instruments, Inc., 1976.

*Primary Examiner*—B. A. Reynolds

*Assistant Examiner*—Philip H. Leung

*Attorney, Agent, or Firm*—Darby & Darby

[57] ABSTRACT

An electronic controlled microwave oven comprising a temperature measuring probe and capable of performing a temperature operation mode is adapted such that when a temperature operation mode is commanded it is detected whether the temperature measuring probe has been connected and if the temperature measuring probe has not been connected an operator is notified of the fact by means of an alarm. Preferably, such detection of a connection state of the temperature measuring probe is performed after a temperature operation mode key is operated until an operation initiate key is operated. Preferably, the above described alarming is performed using a portion of a digital display.

8 Claims, 14 Drawing Figures

FIG. 1A
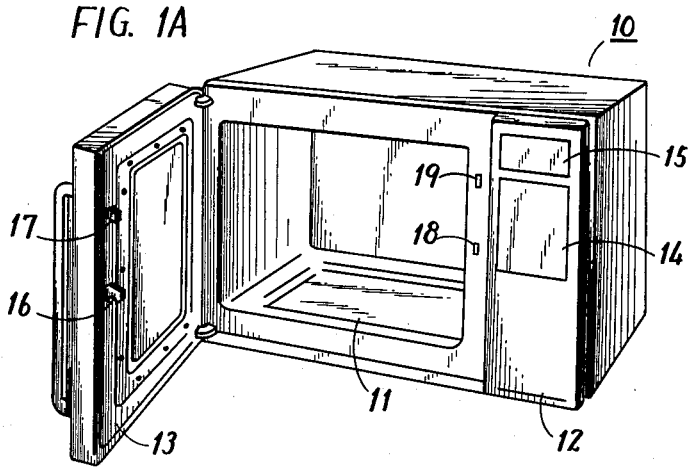
FIG. 1B
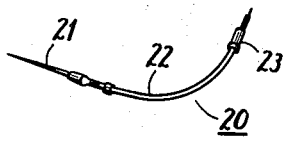
FIG. 3
| | | |
|---|---|---|
| TOD | TIME | TEMP |
| 7 | 8 | 9 |
| 4 | 5 | 6 |
| 1 | 2 | 3 |
| COOK | 0 | |
| CLEAR | START | STOP |
14
FIG. 4
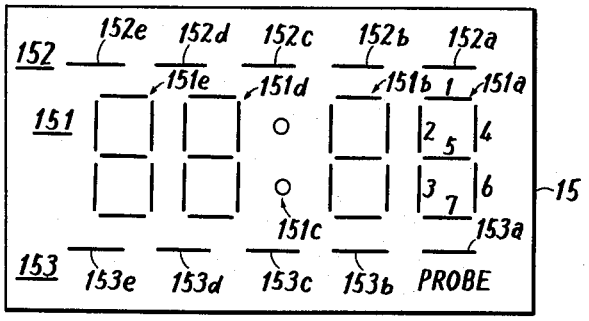

APPARATUS AND METHOD FOR CONTROLLING ELECTRONIC CONTROLLED COOKING APPARATUS

BACKGROUND OF THE INVENTION

1. Field of the Invention

The present invention relates to an apparatus and method for controlling an electronic controlled cooking apparatus. More specifically, the present invention relates to such an apparatus and method for controlling a heat cooking apparatus which is capable of performing a temperature operation.

2. Description of the Prior Art

As an example of a heat cooking apparatus, microwave ovens are well known. Of late, a microprocessor implemented as a large scale integration has been employed in such a microwave oven for the purpose of performing various cooking functions. A microwave oven employing a microprocessor can perform various complicated cooking modes with a simple structure and through a simple manual operation. An example of such cooking modes comprises a temperature operation mode wherein the temperature of a material being cooked is detected and generation of microwave energy is controlled responsive to the detected temperature. Such a microwave oven adapted for performing a temperature operation mode comprises a probe for detecting the temperature of a material being cooked. It has been a common practice that such a probe is placed within a cooking chamber of a microwave oven such that the same is detachably conencted to a predetermined position within the cooking chamber. Typically, such a microwave oven employing a temperature detecting means or a temperature measuring probe is adapted such that for the purpose of safety an operation is not effected even if an operation or heat initiate command is given, unless the probe is properly connected in the temperature operation mode.

Another example of the above described cooking modes comprises a timer operation mode wherein a material being cooked is to be heated only for a time period as in advance set. In the case of such timer operation mode, heating of a material being cooked or generation of a microwave is controlled only as a function of a time period as in advance set by a timer. Although the above described temperature measuring probe is not necessary in such a timer operation mode, if a temperature measuring probe is placed within a cooking chamber as connected to the above described predetermined position, the probe is undesirably heated too much and as a result there is a fear that the probe is damaged. Accordingly, in such a case, for the purpose of safety ovens have been adapted such that generation of microwave energy is disabled even if an operation initiate command is given.

As described in the foregoing, such a microwave oven capable of performing a temperature operation mode or a timer operation mode wherein a temperature detecting means or a temperature measuring probe is connected or disconnected has been adapted such that an operation is not initiated in a certain circumstance even if an operation initiate command is given. However, an operator is inclined to think that even such a case a cooking apparatus per se has been out of order in spite of the fact that merely connection of the probe is the problem. Accordingly, in such a case, it could happen undesirably that the apparatus is not operated for a long period of time, which became a problem from an operation efficiency of the cooking apparatus.

SUMMARY OF THE INVENTION

In order to eliminate the above described problems, the present invention is adapted to notify an operator of the fact that a temperature measuring probe or a temperature detecting means is not in a predetermined connection state. According to the present invention, therefore, in a temperature operation mode, if and when the probe is not in a predetermined connection state, an operation is not effected; however, even in such a case, an operator can immediately learn the cause of a stop of operation through an alarm. Therefore, it is prevented that a cooking apparatus is undesirably not operated for a long period of time and as a result an operation efficiency of a cooking apparatus is enhanced.

According to a preferred embodiment of the present invention, if and when an operator returns a temperature measuring probe or a temperature detecting means to a predetermined connection state or a disconnection state after an alarming operation is performed, a cooking apparatus is placed in a state in which a temperature operation mode or a timer operation mode can be performed, without necessity of any additional manual operation. Therefore, any manual operation for setting again a temperature operation mode or a timer operation mode can be dispensed with and a manual operation convenience is further increased.

According to another embodiment of the present invention, it is adapted such that the above described connection state is detected when a temperature operation mode is commanded and temperature data is inputted, i.e. before an operation initiate command is given. Therefore, it becomes possible for an operator to return such a connection state more promptly.

Therefore, a principal object of the present invention is to provide an improved electronic controlled cooking apparatus.

Another object of the present invention is to provide an electronic controlled cooking apparatus wherein a manual operation convenience is enhanced.

A further object of the present invention is to provide an electronic controlled cooking apparatus wherein a problem caused in conjunction with connection or disconnection of a temperature detecting means can be more promptly remedied.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 1A is a view showing one example of a microwave oven employing the present invention;

FIG. 1B is a view showing a probe as an example of a temperature detecting means;

FIG. 3 is a view showing one example of an entry means or an operation panel;

FIG. 4 is a view showing one example of a display;

DESCRIPTION OF THE PREFERRED EMBODIMENTS

Figure 2:
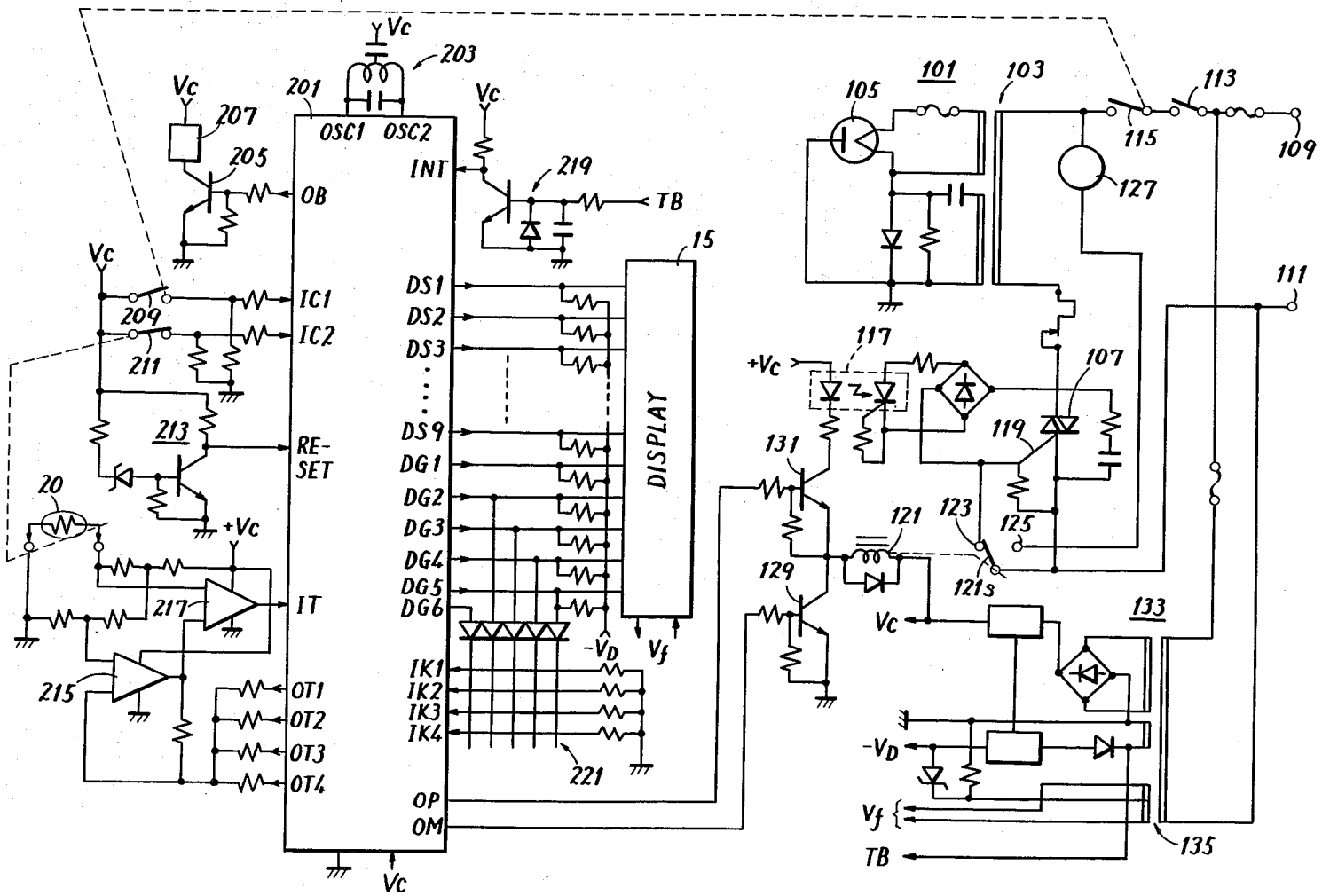
FIG. 2 is a schematic diagram of one embodiment of the present invention.

In the following detailed description of the preferred embodiments of the present invention, the present invention will be described as advantageously employed in a microwave oven. However, it should be pointed out that the present invention is not limited to such embodiments but the present invention can be employed in any other types of heat cooking apparatuses for cooking a material being cooked by application of heat thereto, such as a gas oven, an electric oven, an electric grill, an electric roaster and the like.

FIG. 1A is a perspective view of a microwave oven embodying the present invention. FIG. 1B is a view showing a temperature measuring probe as one example of a temperature detecting means. A microwave oven 10 has a main body comprising a cooking chamber 11 and a control panel 3. The main body of the microwave oven has a door 13 openably/closably provided to enclose an opening of the cooking chamber 4. The control panel 12 comprises an operation portion 14 for setting various cooking modes and for entering necessary data, and a display 15 for displaying in a digital manner the entered data, a measured temperature, a time period left in a timer, and the like. The operation portion 14 and the display portion 15 will be described in more detail subsequently. The door 13 is provided with a door latch 16 and a door switch knob 17 on the inner surface thereof. The door latch 16 and the door switch knob 17 are adapted to enter into apertures 18 and 19, respectively, formed on the main body, when the door 13 is closed, so that an interlock switch and a door switch, respectively, shown in FIG. 2, may be turned on.

A probe 20 comprises a needle-like inserting portion 21 and a plug 23. In using the probe 20, the inserting portion 21 is inserted into a material being cooked, while the plug 23 is coupled to a connecting portion or a receptacle, not shown, provided on the inner wall of the cooking chamber 11. The inserting portion 21 of the probe 20 comprises a thermistor, not shown, housed therein exhibiting a resistance characteristic changeable as a function of a temperature of a material being cooked. The thermistor and the plug 23 are coupled by a shield wire 22, for example, so that the probe 20 is coupled to the circuit shown in FIG. 2 when the probe 20 is utilized.

FIG. 2 is a schematic diagram of a preferred embodiment of the present invention. A microwave generating portion 101 is coupled to terminals 109 and 111 of a commercial power supply through an interlock switch 113 and a door switch 115 and a bidirectional thyristor 107. The microwave generating portion 101 is structured in a well known manner and may comprise a high voltage transformer 103 for transforming a source voltage obtained from the terminals 109 and 111, a magnetron 105 coupled to the output winding of the high voltage transformer 103, and the like. The interlock switch 113 and the door switch 115 are adapted to be turned on by means of the door latches 16 and 18 and the door switch knobs 17 and 19, respectively, shown in FIG. 1A. The bidirectional thyristor 107 is rendered conductive if and when the output voltage of a photocoupler 117 is applied to the gate electrode 119 thereof. Accordingly, if and when the door 13 shown in FIG. 1A is closed and the output voltage is obtained from the photocoupler 117, an alternating source voltage obtained from the terminals 109 and 111 is applied to the microwave generating portion 101 and accordingly microwave energy is generated from the microwave generating portion 101, which microwave energy is supplied to the cooking chamber 11 shown in FIG. 1A. The photocoupler 117 becomes operative if and when first and second transistors 129 and 131 are both rendered conductive, whereby an output voltage is withdrawn.

The gate electrode 119 of the bidirectional thyristor 107 is coupled to the voltage source terminal 111 through a normally closed contact 123 of a relay 121. Accordingly, the thyristor 107 is normally nonoperable and therefore the gate electrode 119 is prevented from being undesirably supplied with a voltage due to an external noise and the like and hence the bidirectional thyristor 107 is prevented from being undesirably rendered conductive. The relay 121 is energized when the first transistor 129 is rendered conductive, a normally opened contact 125 of the relay 121 being connected to a blower motor 127. The blower motor 127 is adapted for driving a fan, not shown, for cooling the magnetron 105 and the like. The voltage source terminals 109 and 111 are further connected to a control voltage source 133. The control voltage source 133 comprises a transformer 135 for transforming the voltage supplied from the terminals 109 and 111 to a lower voltage for supplying direct current source voltages $V_C$ and $-VD$ fed to various portions of the circuit, a voltage Vf fed to a display 15 and a time base signal TB.

Figure 5:
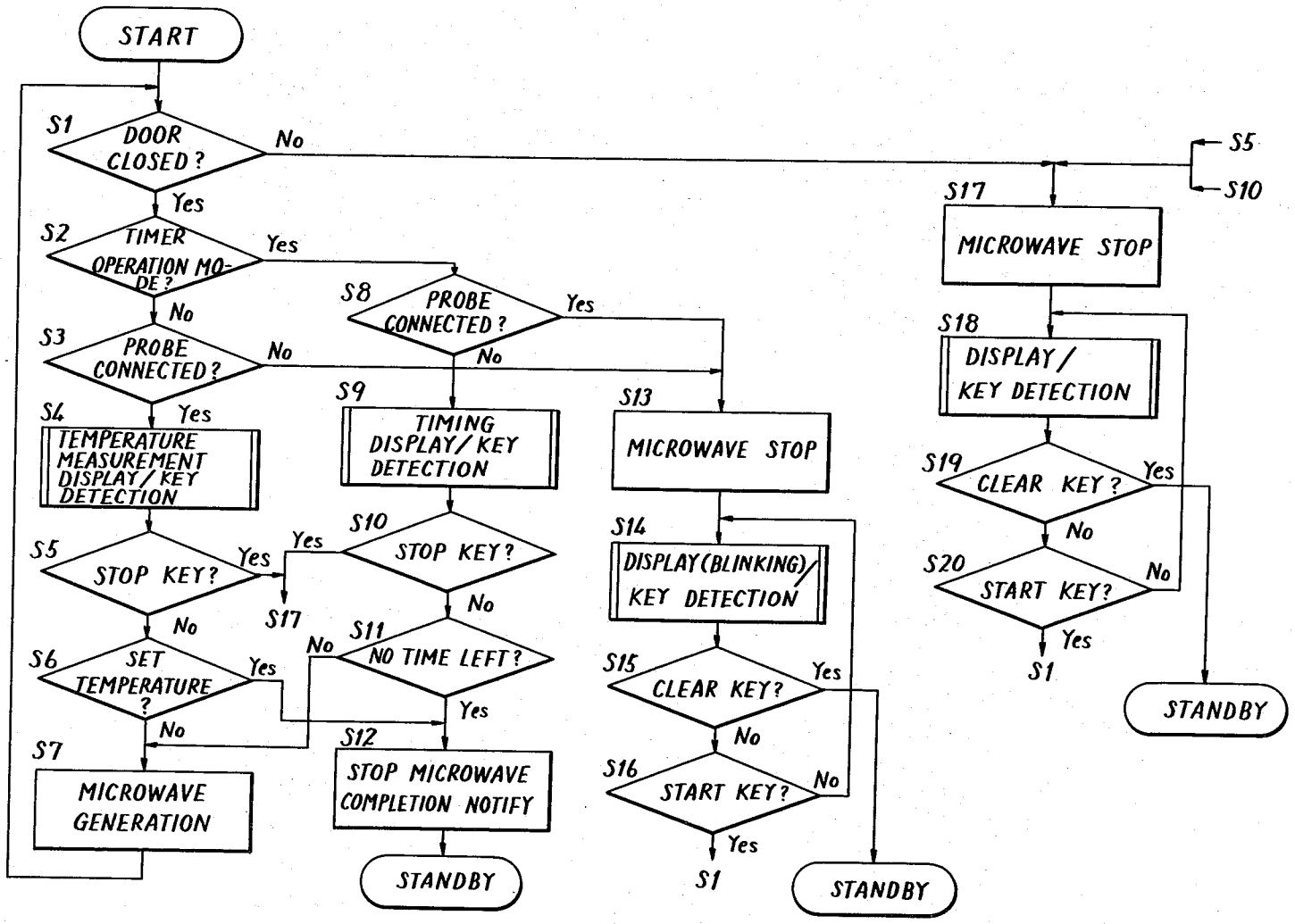
FIG. 5 is a flow diagram for depicting an operation of one embodiment of the present invention.
Figure 10:
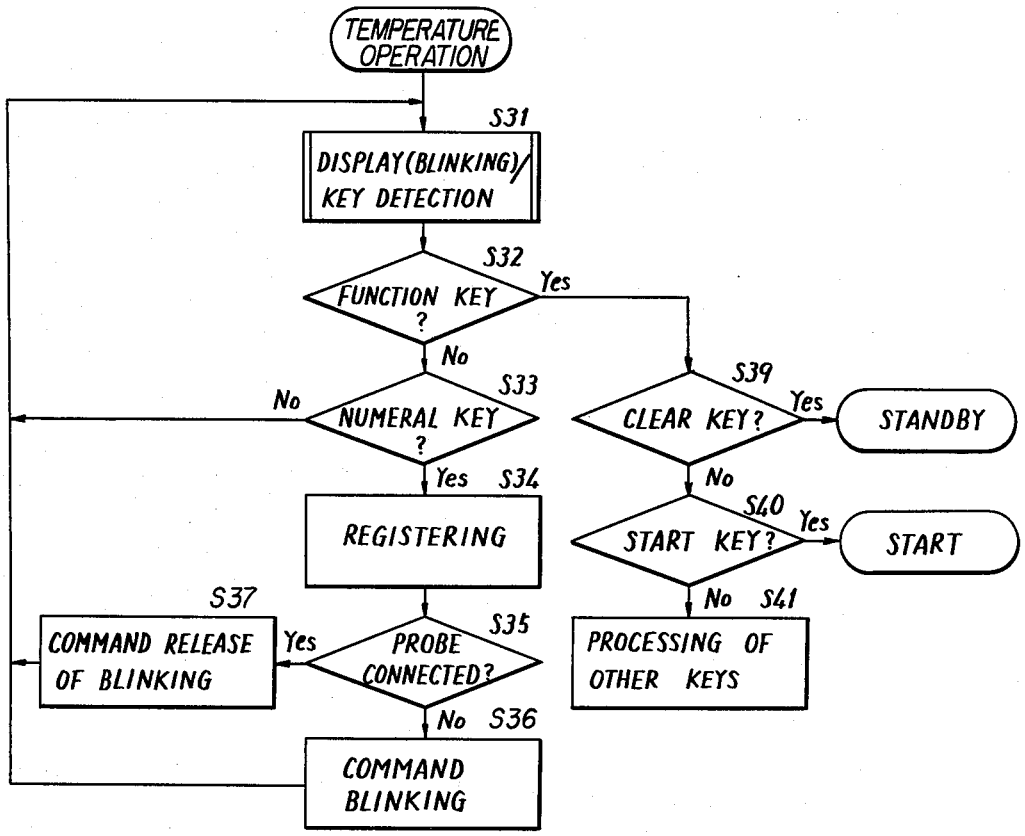
FIG. 10 is a flow diagram depicting an operation of another embodiment of the present invention.

The embodiment shown employs a one chip microprocessor implemented as a large scale integration for controlling the above described microwave generating portion 101 and the like. The microprocessor 201 may be model "μPD553" manufactured by Nippon Electric Company Limited, Japan, for example. Such microprocessor 201 has a multiplicity of input and output terminals. Connection terminals OSC1 and OSC2 are used for connecting an external component 203 constituting a portion of a clock source. The external component 203 is cooperative with the microprocessor 201 to generate a synchronizing clock, so that the microprocessor 201 may execute the program steps in synchronism with the clock. Although not shown in the figure, the microprocessor 201 comprises a read only memory having system programs as shown in FIGS. 5 and 10 to be described subsequently, a random access memory for storing data, an arithmetic logic unit and the like, as well known to those skilled in the art.

The microprocessor 201 is coupled to the display 15 through data output terminals DS1 to DS9. The display 15 is further supplied with a display control signal through control signal output terminals DG1 to DG5. The display control signal functions as a digit selecting signal for driving in a time sharing basis each display digit to be described subsequently of the display 15. The control signal terminals DG2 to DG5 and an additional control signal output terminal DG6 are coupled to column lines of a key matrix 221. The key matrix 221 comprises four row lines connected to key input terminals IK1, IK2, IK3 and IK4 of the microprocessor 201. The above described column lines and row lines constitute a matrix, such that an intersection of each column line and each row line is provided with a key switch of the operation portion 14 (see FIG. 3). The operation portion 14 comprises ten numeral keys standing for numerals "0" to "9" and seven function keys, as shown in FIG. 3. The function keys comprise those keys denoted as TOD, TIME, TEMP, COOK, CLEAR, START, and STOP. The TOD key is used for time setting. The TIME key is used for setting a timer operation mode. The TEMP key is used for setting a temperature operation mode. The COOK key is used for setting a heat cooking mode. The START key is used for commanding initiation of microwave generation by the magnetron 46. The STOP key is used to stop or discontinue the operation. Each of these keys may be implemented by a typical contact type depression button switch. The input from the key matrix 221 coupled to these keys is applied to the key input terminals IK1 to IK4 as a key code signal. The microprocessor 201 is responsive to the key code signal applied to the terminals IK1 to IK4 to detect or identifiy which key is depressed.

The display 15 is structured as shown in FIG. 4, for example, by means of a fluorescent type display tube. More specifically, the display 15 comprises a numerical valve display portion 151 and bar display portions 152 and 153. The numerical value display portion 151 comprises four numeral display portions 151*a*, 151*b*, 151*d* and 151*e*, each including an "8" shaped segment arrangement, and a colon display portion 151*c* formed between the numeral display portions 151*b* and 151*d*. The bar display portions 152 and 153 each have bar segments 152*a* to 152*e* and 153*a* to 153*e* corresponding to each of the digits of the numerical value display portion 151. An indication "PROBE" is formed below the bar segment 153*a*. The output signal obtained from the output teminals DG1 to DG5 of the microprocessor 201 functions as a digit selecting signal of the respective display digits a to e. On the other hand, the output signal obtained from the output terminals DS1 to DS7 functions as a segment selecting signal corresponding to the respective segments in each of the numeral display portions. The output signal obtained from the output terminals DS8 and DS9 functions as a selection signal of the bar display portions 152 and 153. Accordingly, if and when a signal is obtained from the output terminal DG2, for example, and the output signal is obtained at the terminals DS1, DS3, DS4, DS5, DS7 and DS8 and DS9, a numeral "2" is displayed at the numeral display portion 151*b* and the bar segments 152*b* and 153*b* are enabled to emit light. The output signal obtained from the output terminal DS1 functions as a selection signal of the colon display 151*c*. Accordingly, if and when the output signal is obtained from the output terminal DG3 and the output signal is obtained from the terminals DS1 and DS8, the colon display 151*c* is enabled to emit light and the bar segment 152*c* is also enabled to emit light.

Returning to FIG. 2, the output terminal OB of the microprocessor 201 is a buzzer terminal. If and when an output signal is obtained at the terminal OB, the transistor 205 coupled thereto is rendered conductive, whereby the buzzer 207 is driven to raise an alarm. The buzzer 207 is used as a confirmation alarm responsive to a key operation of the above described operation portion 14, completion of cooking, and the like. However, the buzzer 207 may also be used as one of alarming means to be described subsequently.

The input terminal IC1 of the microprocessor 201 is an input terminal for detecting an opened/closed state of the door 13 shown in FIG. 1. More specifically, the second door switch 209 adapted to be turned on responsive to the door switch knob 17 (FIG. 1) is connected to the input terminal IC1. Accordingly, in the absence of the input signal at the terminal IC1, i.e. if and when the second door switch 209 is turned off, the microprocessor 201 determines that the door 13 has been opened. In such a situation, the microprocessor 201 performs necessary operations such as interruption of its own operation, and the like.

The input terminal IC2 is an input terminal for detecting a connected/disconnected state of the probe 20. More specifically, a probe switch 211 for connecting the probe 20 is connected to the input terminal IC2. The probe switch 211 is operable in a ganged fashion with a receptacle, not shown, provided on the inner wall of the cooking chamber 11 (FIG. 1), such that the probe switch 211 is turned on when the probe 20 is connected to the receptacle. Accordingly, the microprocessor 201 determines a connected/disconnected state of the probe 20 based on presence or absence of an input signal to the input terminal IC2.

The input terminal RESET is a terminal for initially resetting the microprocessor 201 upon turning on of a power supply to the microwave oven. More specifically, if and when the power supply is turned on, the rise of the source voltage $V_C$ obtained from the control voltage source 133 is detected by means of a detecting circuit 213 implemented by a transistor and a Zener diode. The output from the detecting circuit 213 is applied to the terminal RESET. Then the microprocessor 201 resets the respective portions to an initial condition.

The input terminal IT and the output terminals OT1 to OT4 are terminals for temperature measurement by the probe 20. The microprocessor 201 provides a binary signal of four bits at the output terminals OT1 to OT4, so that bit pattern of the binary signal is changed in a cyclic manner at a high speed to sixteen states of "0000", "0001", . . . "0100", . . . "1100", . . . "1111". The above described sixteen states of the binary signal each have been defined to represent a particular temperature. For example, the bit pattern "0000" is allotted to 185° F., for example, and the bit pattern "1111" is allotted to 110° F., for example, while one change of the bit pattern is allotted to a change of 5° F. The binary signal output of four bits at the output terminals OT1 to OT4 are converted to a stepwise analog voltage by means of an amplifier 215 commonly coupled to resistors coupled to the output terminals OT1 to OT4, respectively. The analog voltage obtained from the amplifier 215 contains information concerning the binary signal, i.e. the temperature and is applied to one input of a comparator 217. The other input of the comparator 217 is connected to receive a voltage associated with the temperature of a material being cooked, not shown, obtained from the probe 20 connected to the receptacle, not shown. The comparator 217 provides a coincidence signal if and when these two input voltages coincide with each other, which coincidence signal is applied to the input terminal IT of the microprocessor 201. If and when the signal is received at the terminal IT, the microprocessor 201 immediately stops a change of the above described four-bit pattern of the binary signal. More specifically, a bit pattern of the four-bit binary signal obtainable when the above described coincidence signal is inputted substantially corresponds to a temperature of the material being cooked as detected by the probe 20 and the microprocessor 201 processes the above described bit pattern of the binary signal as a temperature of the material being cooked.

An interrupt signal is applied to the input terminal INT of the microprocessor 201. More specifically, the time base signal obtained from the above described control voltage source 133 is an alternating current signal of say 60 Hz and is shaped into a pulse signal of say 60 Hz by means of a wave shaping circuit 219 comprising a transistor, a diode and a capacitor, whereupon the pulse signal is applied to the input terminal INT. Each time the pulse signal obtained from the wave shaping circuit 219 is applied to the input terminal INT, the microprocessor 201 interrupts any other processing, whereupon timing processing is performed. More specifically, the microprocessor 201 functions to generate a signal representing "second", a signal representing "minute", and a signal representing "hour" in synchronism with the above described pulse signal of 60 Hz.

Finally, the output terminals OM and OP are a heat command terminal and an output level command terminal, respectively. In performing a heat processing operation, the microprocessor 201 just provides an output signal at the output terminal OM and then provides an output signal at the output terminal OP with a slight delay. Upon completion of execution of the heating operation, the output signals at the two terminals OM and OP are caused to disappear. If and when the output signal is obtained at the output terminal OM, the first transistor 129 is rendered conductive and accordingly the relay 121 is energized. Accordingly, the normally closed contact 123 is turned off and the normally opened contact 125 is turned on. Accordingly, a non-operable state of the gate electrode 119 of the bidirectional thyristor 107 is released and the blower motor 127 is energized. When the output is obtained from the output terminal OP thereafter, the second transistor 131 is rendered conductive and the photocoupler 117 becomes operative. Then the output signal at the output terminal OP is obtained for a time period associated with an output level being set within each cycle which is determined as 10 seconds, for example. Assuming that a microwave output generated by the magnetron 105 is selected to be the maximum level, for example, the output signal is obtained for full period of time in each cycle, and assuming that the microwave output is selected to be a 50% level, the output signal is obtained for five second, for example, within each cycle.

Now that a structure of a preferred embodiment of the present invention was described in the foregoing, a control operation by the microprocessor 201 will be described in detail in the following in conjunction with an example of a key operation by the operation portion 14 and an example of display manners by the display portion 15.

STANDBY STATE

Figure 6:
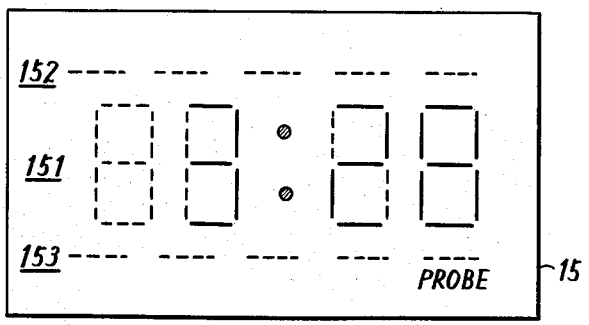
FIGS. 6, 7A, 7B, 7C, 8A, 8B and 9 are views showing examples of display manners by the display.

As far as the microwave oven is in an enabled state, the microprocessor 201 is responsive to the input signal at the input terminal INT to perform a timing operation as described previously irrespective of a key operation by the operation portion 14 and the current time is renewed by a current time storing region which is an accessible region included in the random access memory of the microprocessor 201. Now assuming that no key operation is made by the operation portion 14 and therefore the microwave oven is in a standby state, then the current time is normally displayed by the display 15. FIG. 6 shows such a display manner and in case of the display manner shown twenty-eight minute past three o'clock is displayed.

TIME ADJUSTMENT

In order to adjust the current time displayed by the display 15 to say just 4 o'clock, the following key operation is made by the operation portion 14:

[TOD] [4] [0] [0] [TOD]

Figure 7A:
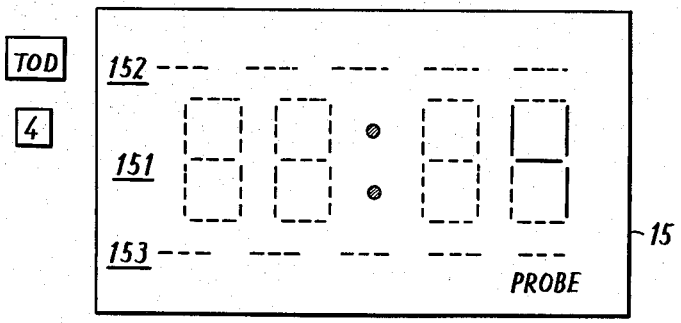
Figure 7B:
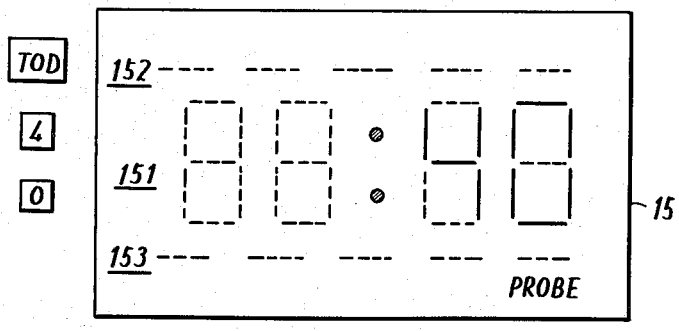
Figure 7C:
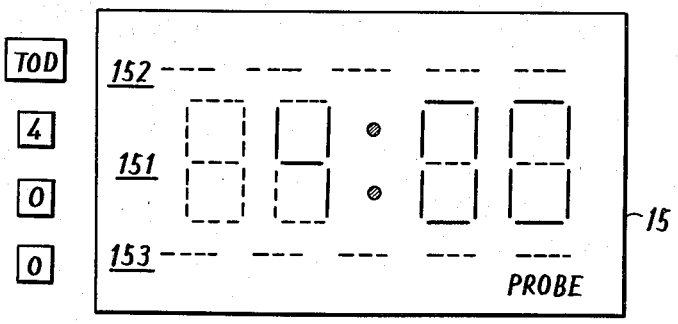

Upon entering "400" following depression of the TOD key, the data representing the time of just 4 o'clock is written in the current time storing region of the microprocessor 201 and the second depression of the TOD key just at 4 o'clock completes time adjustment. FIGS. 7A to 7C show a change of the display manners by the display 15 in accordance with the above described key operation.

TIMER OPERATION

Now consider a case where the microwave oven is operated with the output value of 50% of the maximum microwave output for ten minutes thirty seconds. In such a case, the following key operation is made by the operation portion 14.

[TIME] [1] [0] [3] [0] [COOK] [5] [0] [START]

Figure 8A:
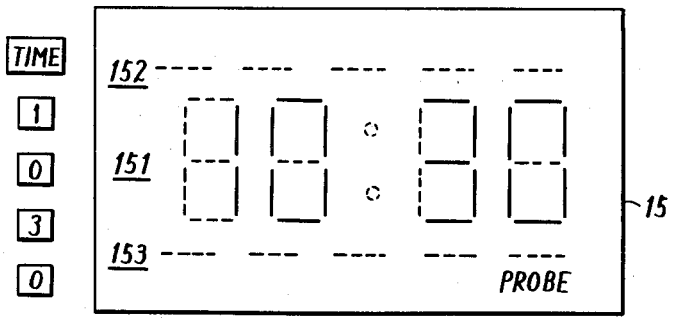
Figure 8B:
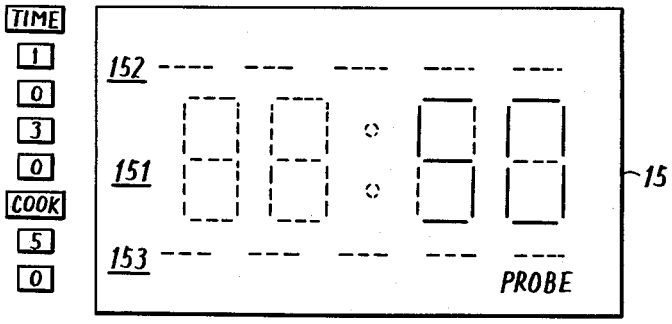

On that occasion the data representing a timp period of ten minutes thirty seconds is written into a timer time period storing region of the random access memory in the microprocessor 201, while the data representing the output value of 50% is written in an output level storing region of the random access memory in the microprocessor 201. At the same time, a flag, i.e. a one bit signal, is loaded in a timer command storing region of the random access memory, thereby to store a timer operation command. FIGS. 8A and 8B show a change of the display manners by the display 15 in accordance with the above described key operation.

At the step S1 which is the first step of the program, an opened state of the door 13 is checked responsive to the signal at the input terminal IC1. If and when the door 13 has been closed, the program proceeds to the step S2, whereupon it is determined whether or not the timer operation is being made. The determination is made by determining whether the flag is available in the above described timer command storing region.

Since the timer operation has been made, the program shifts to the step S8, where a connection state of the probe 20 is determined responsive to the signal obtained at the input terminal IC2. Assuming that the probe 20 has not been connected, then the program proceeds to the step S9. At the step S9 the content in the above described timer time period storing region is reduced responsive to the second signal and the content thereof is displayed by the display 15, while the key input signal is also received from the operation portion 14.

At the following step S10, it is determined whether the above described key input is of the STOP key or not. Assuming that the key operation is not presently made, then the program shifts to the step S11, where it is determined whether the content in the above described timer time period storing region is zero or not. Since the same has been previously set and presently is not zero, the program shifts to the step S7.

At the step S7, oscillation of the magnetron 105 is commanded. More specifically, the outputs are sequentially generated at the output terminals OM and OP of the microprocessor 201. The program then returns to the step S1 and thereafter the above described steps S2, S8, S9, S10, S11, S7 and S1 are circulated, while at every one second during the above described process the content in the timer time period storing region is reduced, with the result that a time period left in the timer is displayed by the display 15. At the above described step S7 in the above described circulation process the output of the terminal OP is cyclically brought to the high level or the low level as a function of the content in the above described output level storing region. More specifically, in the above described case, since the content in the above described output level storing region is "50", the output of the terminal OP is obtained only for five second in each cycle, with one cycle being determined as 10 second.

If and when the door 13 is opened in the above described circulation process, the opened state of the door 13 is detected at the step S1, whereupon the program shifts to the step S17, where the respective outputs at the terminals OM and OP are caused to disappear. At the following step S18, the content in the above described timer time period storing region is displayed and the key input signal is received from the operation portion 14. The program then proceeds to the respective steps S19 and S20. At the step S19, it is determined whether the above described input key is of the CLEAR key or not and in the case where the above described input key is of the CLEAR key, the program returns to the above described standby state after clearing all the storing regions excluding those for the current time. Otherwise, the program shifts to the step S20. At the step S20, it is determined whether the above described input key is of the START key or not and in the case where the above described input key is of the START key, the program returns to the step S1, while otherwise the program returns to the step S18. Accordingly, if and when the door 13 is closed thereafter and again the START key is operated again, the above described circulation process is restarted.

If and when the STOP key is operated by the operation portion 14 in the above described circulation process, it is detected at the step S10 and the program shifts to the step S17. Accordingly, when the CLEAR key is operated thereafter, the program returns to the standby state after clearing all the storing regions excluding those for the current time in the microprocessor 201. On the other hand, if the START key is operated, the program returns to the step S1.

If and when a timer time period lapses during the above described circulation process, the same is detected at the step S11 and the program enters into the step S12. At the step S12, the outputs at the output terminals OM and OP of the microprocessor 201 are caused to fully disappear, whereupon an output is obtained for a given period of time at the output terminal OB. At the same time, all the storing regions excluding those for the current time in the microprocessor 201 are cleared. Thus, the timer operation mode is terminated and the buzzer 207 is enabled to raise an alarm for a given period of time, whereupon the microwave oven returns to the above described standby state.

Meanwhile, in initiating the above described timer operation mode, if and when the probe 20 has been connected, i.e. a signal is obtained at the terminal IC2, it is detected at the step S8, whereupon the program shifts to the step S13. At the step S13, the outputs at the terminals OP and OM of the microprocessor 201 are caused to disappear. At the following step S14, an output is generated at the terminal DS9 in synchronism with the output at the terminal DG1. Accordingly, the bar segment **153*a* below the indication "PROBE" in the display 15 is commanded to be enabled in a blinking manner and at the step S14 the key input signal is received from the operation portion 14**.

The program then proceeds to the following steps S15 and S16. At the step S15, it is determined whether the above described input key is of the CLEAR key or not and in the case where the above described input key is of the CLEAR key the program returns to the standby state after clearing all the storing regions excluding those for the current time in the microprocessor 201, and otherwise the program shifts to the step S16. At the step S16, it is determined whether the above described input key is of the START key or not. In the case where the above described input key is of the START key, the program returns to the step S1, and otherwise the program returns to the step S14.

Figure 9:
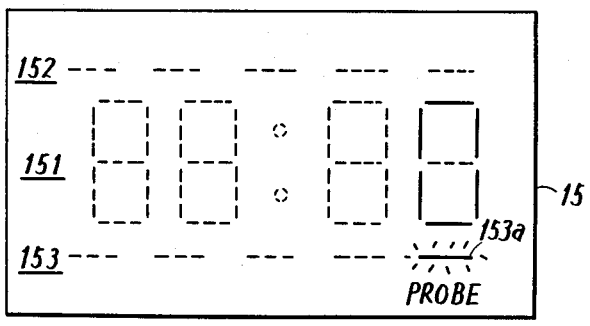

Accordingly, unless the CLEAR key or the START key are operated, the program makes circulation of the steps S14, S15 and S16. A blinking light emission command at the step S14 is specifically such that one cycle is determined as say two second and in each cycle an output is obtained for one second at the terminal DS9. Accordingly, in the above described circulation process the above described bar segment **153*a* is caused to make blinking light emission at the cycle of one second. FIG. 9** shows a display manner in such a situation.

If and when the door 13 is opened, the probe 20 is disconnected and then the door 13 is again closed and the START key is operated in the above described circulation process of the steps S14, S15 and S16, the above described normal timer operation is performed, as is apparent.

TEMPERATURE OPERATION

Now consider a case where the temperature of a material being cooked is raised to 150° F. using a 50% output value of the maximum microwave output. In such a case, the following key operation is made by the operation portion 14.

[TEMP] [1] [5] [0] [COOK] [5] [0] [START]

The data representing 150° F. is loaded in a set temperature storing region in the microprocessor 201 and the data representing the 50% output value is loaded in an output level storing region in the microprocessor 201. Then, as in case of the timer operation, the input data is in succession displayed by the display 15.

If and when the START key is operated, the microprocessor 201 executes the program shown in FIG. 5.

As in case of the timer operation, the program proceeds through the step S1 to the step S2, where it is determined that the operation is not the timer operation, whereupon the program proceeds to the step S3. At the step S3, the connection state of the probe 20 is detected based on the signal obtained at the input terminal IC2. If and when the probe 20 has been connected, the program proceeds to the step S4, while otherwise the program shifts to the step S13. Now assuming that the probe 20 has been connected, then the program proceeds to the step S4. At the step S4, temperature measurement is made of a material being cooked, i.e. a change of the bit pattern of the above described four-bit binary signal occurs form "0000" to "1111". When a signal is applied from the comparator 217 to the input terminal IT, the measured temperature value is displayed by the display 15. At the step S4, the key input signal is also received from the operation portion 14.

At the following step S5, it is determined whether the above described key input is of the STOP key or not. Assuming that no key operation is presently made, then the program proceeds to the step S6. At the step S6, it is determined whether the above described measured temperature has reached a set temperature stored in the set temperature storing region of the microprocessor 201. Assuming that the above described measured temperature has not reached the set temperature stored in the storing region of the microprocessor, then the program shifts to the above described step S7.

Accordingly, thwe program makes circulation of the respective steps S1 to S7, wherein microwave oscillation of the 50% output value is made during the circulation process, while the temperature of a material being cooked is displayed in succession by the display 15.

If and when the temperature of a material being cooked reaches the set temperature in the above described circulation process, it is detected at the step S6, whereupon the program shifts to the step S12. More specifically, after the temperature operation mode is terminated and the buzzer 207 is enabled to make an alarm for a given period, the microwave oven is returned to the standby state.

During the circulation process of the above described steps S1 to S7, if and when the door 13 is opened or the STOP key is operated, the operation of the microwave oven is interrupted, as in case of the timer operation. If and when the probe 20 has not been connected at the start of the temperature operation, it is detected at the step S3, whereupon the program shifts to the step S13. At the step S13, the segment 153*a* below the indication "PROBE" in the display 15 is enabled to make a blinking display, as in case of the timer operation.

Meanwhile, although in the above described embodiment a particular bar segment 153*a* was enabled to make a blinking display in accordance with a connected or disconnected state of the probe 20, the display is not limited thereto and alternatively a particular character may be displayed or is caused to blink by the numeral display portion 151 and alternatively the buzzer 207 may be enabled to raise an alarm, solely or together with the above described alarm indication.

FIG. 10 is a flow diagram showing one example of another control operation of the embodiment. FIG. 10 only shows a case of the temperature operation mode which is of particular interest to the present invention. If and when the above described TEMP key is operated for the purpose of the temperature operation mode, then the miroprocessor 201 makes display and key detection at the step S31, as in case of the step S18 shown in FIG. 5. Then it is determined through key detection whether the key operated following the TEMP key operation is of a function key or not (at the step S32). It is supposed that in setting the normal temperature operation mode a numeral key is operated after the TEMP key is operated, as described previously. Accordingly, after the step S32 the step 33 follows, where it is determined whether the just operated key is of a numeral key or not. If the operated key is of a numeral key, a numerical value corresponding to the numeral key is stored in the random access memory, for example, to register the numeral (at the step S34). After registration of the numeral at the step S34, the microprocessor 201 proceeds to the step S35, where it is determined whether the probe has been connected or not, just as in the case of the step S3 shown in FIG. 5. If the probe has not been connected, the display 15 is commanded to make a blinking display, whereby the bar segment 153*a* (FIG. 4), for example, is enabled to make a blinking display, as in the case of the step S14 shown in FIG. 5. Meanwhile, at the step S35, if the probe has been connected, the temperature operation can be made and therefore a release of a blinking display is commanded. Accordingly, at the step S35, it is once determined that the probe has not been connected and, if an operator notices it after execution of the step S36 and connects the probe, then after the second execution of the step S35, the program shifts to the step S37. Accordingly, if an operator simply checks and corrects the predetermined connection state of the probe, then the setting operation and the operation initiate command operation can be continually made. More specifically, if and when a blink release command is issued at the step S37 and a display/key detection is again performed at the step S31, again it is determined which key was operated, a function key or a numeral key, whereupon if it is determined that a numeral key was operated, a temperature of a material being cooked can be set. After setting of the temperature, the COOK key is operated, as described previously, whereupon a numerical value commanding an output level of the magnetron is entered and then the START key is operated, so that the temperature operation mode is executed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electronically controlled cooking apparatus, comprising:

heating energy generating means for providing heating energy to a material being cooked, control means for controlling said heating energy generating means in accordance with a predetermined cooking operation, said control means having a temperature input for determining its operation, data entry means including a temperature operation mode commanding means for commanding the performance of a temperature operting mode and a time operation mode commanding means for commanding the performance of a time operation mode, means for selectively entering numerical data for the temperature of said temperature operating mode, and heating initiate command means for commanding initiation of the operation of said heating energy generating means, storage means for storing said data entered from said entry means of the performance of said temperature mode and the numerical data, temperature detecting means adapted for detachable electrical coupling to said temperature input of said control means for detecting thwe temperature of said material being cooked, coupling state detecting means responsive to operation of said temperature operation mode commanding means and said heating initiate command means for initiating the operation of said heating energy generating means for producing a first output if said temperature detecting means is uncoupled from said temperature input and producing a second output if said temperature detecting means is coupled to said temperature input, said coupling state detecting means being further responsive to operation of said time operation mode commanding means for producing a third output if said temperature detecting means is coupled to said temperature input of said control means, means for producing a sensory perceptible alarm signal, said control means including first command means responsive to said first output from said coupling state detecting means for enabling said alarm means and inhibiting the operation of said heating energy generating means, second command means responsive to production of said second output of said coupling state detecting means following the initiation of said alarm signal and after coupling of the temperature detecting means to said temperature input of said control means for controlling said heating energy generating means based on said data entered by said entry means prior to initiation of said alarm signal and said temperature of said material being cooked as detected by said temperature detecting means, and invalidating means responsive to said third output of said coupling state detecting means for invalidating an operation of said heating initiate commanding means and enabling said alarm means.

2. A control apparatus in accordance with claim 1, wherein said alarm means comprises at least one of visual signal means and audible signal means.

3. A control apparatus in accordance with claim 2, wherein:

said cooking apparatus further comprises display means for displaying at least a portion of said entered data, and said visual signal means comprises a portion of said display means.

4. A control apparatus as in either claim 1 or claim 3, wherein:

said heating energy generating means comprises microwave generating means.

5. An electronically controlled cooking apparatus as in claim 1 wherein said first command means is responsive to an operation of said heating initiation commanding means following entry of said numerical data.

6. An electronically controlled cooking apparatus as in claim 5 wherein said second command means is responsive to further operation of said heating initiation commanding means.

7. An electronically controlled cooking apparatus as in claim 6 wherein said numerical data comprises at least temperature data defining a temperature to be reached by the material being cooked.

8. An apparatus as in either of claims 1 or claim 3 wherein said control means comprises microprocessor means.

* * * * *